United States Patent [19]

Walton et al.

[11] Patent Number: 4,645,193

[45] **Date of Patent: * Feb. 24, 1987**

[54] FABRIC PICKUP AND THE LIKE

[75] Inventors: Richard R. Walton, Ten W. Hill Pl., Boston, Mass. 02114; George E. Munchbach, Roslindale, Mass.

[73] Assignee: Richard R. Walton, Boston, Mass.

[ * ] Notice: The portion of the term of this patent subsequent to Feb. 10, 2004 has been disclaimed.

[21] Appl. No.: 614,478

[22] Filed: May 30, 1984

[51] Int. Cl.[4] ..... B65H 3/22

[52] U.S. Cl. ..... 271/18.3; 294/61; 414/120

[58] Field of Search ..... 271/18.3, 19, 20, 21, 271/22, 23, 24, 25, 33; 414/120; 294/61, 88; 112/311, 132; 223/32, 31

[56] References Cited

U.S. PATENT DOCUMENTS

| | | | |
|---|---|---|---|
| 793,009 | 6/1905 | Miller | 271/18.3 |
| 1,649,310 | 11/1927 | Molyneux | 464/58 |
| 1,780,195 | 11/1930 | Kinney | 271/18.3 |
| 2,837,333 | 6/1958 | Sindzinski | 271/12 |
| 2,878,016 | 3/1959 | Russell et al. | 271/11 |
| 2,919,129 | 12/1959 | Sjostrom | 271/33 |
| 3,026,109 | 3/1962 | Pfeffer | 271/32 |
| 3,064,968 | 11/1962 | Starns | 271/19 |
| 3,083,961 | 4/1963 | Arbter | 271/33 |
| 3,168,308 | 2/1965 | Walton et al. | 271/27 |
| 3,176,979 | 4/1965 | Engleman | 271/18 |
| 3,253,827 | 5/1966 | Southwell et al. | 271/19 |
| 3,291,480 | 12/1966 | Haddad | 271/1 |
| 3,353,821 | 11/1967 | Smith et al. | 271/16 |
| 3,355,165 | 11/1967 | Southwell et al. | 271/18.3 |
| 3,369,803 | 2/1968 | Walton et al. | 271/10 |
| 3,386,396 | 6/1968 | Jacobs et al. | 112/2 |
| 3,386,763 | 6/1968 | Ottaway et al. | 294/61 |
| 3,406,961 | 10/1968 | Walton | 271/10 |
| 3,406,966 | 10/1968 | Walton | 271/68 |
| 3,430,949 | 3/1969 | Herdeg et al. | 271/63 |
| 3,442,505 | 5/1969 | Szentkuki | 271/1 |
| 3,531,103 | 9/1970 | Walton | 271/26 |
| 3,539,177 | 11/1970 | Schwenk | 271/33 |
| 3,547,432 | 12/1970 | Herdeg | 271/20 |
| 3,550,932 | 12/1970 | Mason | 271/26 |
| 3,583,341 | 6/1971 | Birdsong | 112/121 |

List Continued on next page.

FOREIGN PATENT DOCUMENTS

| | | | |
|---|---|---|---|
| 2188578 | 1/1974 | France | |
| 1252515 | 12/1960 | France | 271/26 R |
| 1218433 | 1/1971 | United Kingdom | |

OTHER PUBLICATIONS

Murray, John M., "Single-Ply Pickup Devices", *Bobbin, AMMA Apparel Research Journal*, 12/75, pp. 87–99.

*USM Fabric Feeder, Model UFFM*, USM.

*USM Today*, Oct. 1970.

*Fabri-Feed, USM Fabric Edge Finishing Machine Model UFEF*, USM.

*The Revolutionary Hydrafolder*, Hydraytor Co.

*Fabri-Feed, USM Knit Sleeve Hemming System, Model UKSH*, USM.

*Fabri-Feed, USM Label Fusing System, Model ULFS-B*, USM.

*Clupicker Automated Systems*, Jetscrew from Cluett.

*GEPEC Cloth Pickup*, GEPEC Machinery.

*Primary Examiner*—Duane A. Reger

*Assistant Examiner*—Matthew C. Graham

[57] ABSTRACT

A pickup device for sheet-form flexible fabric comprising first and second gripping elements which move laterally in the plane of the fabric in an angle to the direction of clamping, whereby the fabric is tensioned before clamping. Preferably the clamping elements of the teeth have vertical frontal edges, the teeth arranged to come together during final motion, and preferably the teeth being in matching parallel lines. Jets of air are employed to assist in separation, either blowing down at the gripping lines, or between pairs of devices that tension the fabric, or, in regions where the fabric droops below a lifting pickup, using a device that moves the jets closely against the drooping fabric portion. An array of such pickups is rotated about an axis to turn upside down or end for end. All features can be achieved simply by lines of teeth carried on elongated spring arms that are cammed together.

29 Claims, 44 Drawing Figures

U.S. PATENT DOCUMENTS

| | | | |
|---|---|---|---|
| 3,583,695 | 6/1971 | Sherwood | 271/21 |
| 3,588,087 | 6/1971 | Rovin | 270/58 |
| 3,588,091 | 6/1971 | Stone et al. | 271/19 |
| 3,588,092 | 6/1971 | Dubes | 271/19 |
| 3,593,991 | 7/1971 | Baron | 271/70 |
| 3,625,506 | 12/1971 | Rovin | 271/18 |
| 3,632,106 | 1/1972 | Schwenk | 271/68 |
| 3,670,674 | 6/1972 | Connor, Jr. | 112/121.29 |
| 3,672,314 | 6/1972 | Firestein et al. | 112/121.29 |
| 3,685,471 | 8/1972 | Reynolds | 112/121.29 |
| 3,704,884 | 12/1972 | Nicolay | 271/85 |
| 3,710,953 | 1/1973 | Kirsch | 241/1 |
| 3,727,775 | 4/1973 | Beazley | 214/1 |
| 3,747,919 | 7/1973 | Stwert et al. | 271/19 |
| 3,756,587 | 9/1973 | Lutts et al. | 271/20 |
| 3,765,712 | 10/1973 | Hardy et al. | 294/87 R |
| 3,806,114 | 4/1974 | Carter | 271/20 |
| 3,809,388 | 5/1974 | Downing | 271/20 |
| 3,813,094 | 5/1974 | Walton | 271/19 |
| 3,902,750 | 9/1975 | Roitel | 271/18.3 X |
| 3,981,495 | 9/1976 | Bijttebier | 271/18.3 |
| 4,239,205 | 12/1980 | Bourque | 271/175 |
| 4,505,468 | 3/1985 | Heisler | 294/61 |

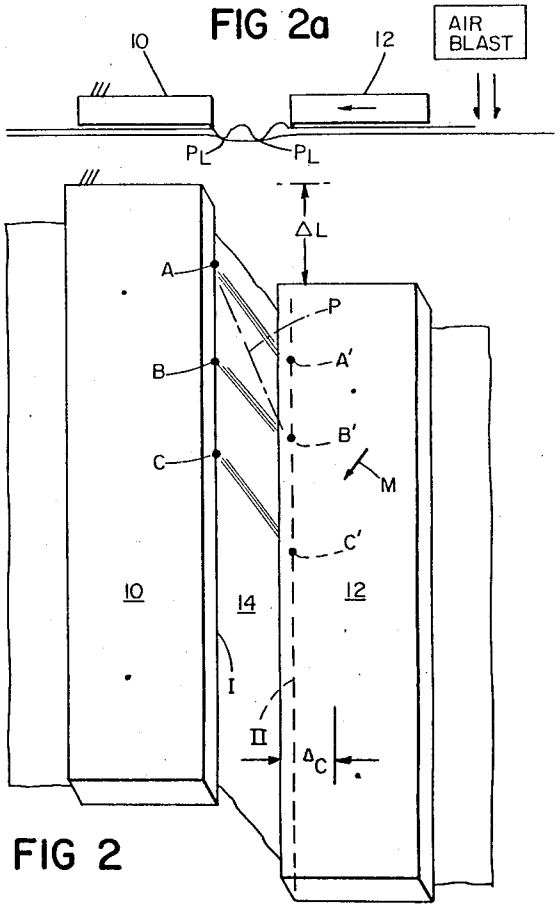
FIG 2a
FIG 2
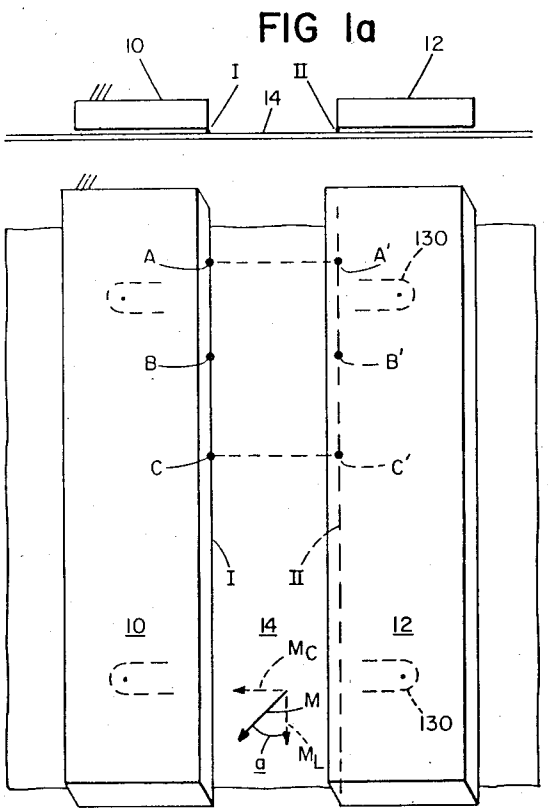
FIG 1a
FIG 1

FIG 4a
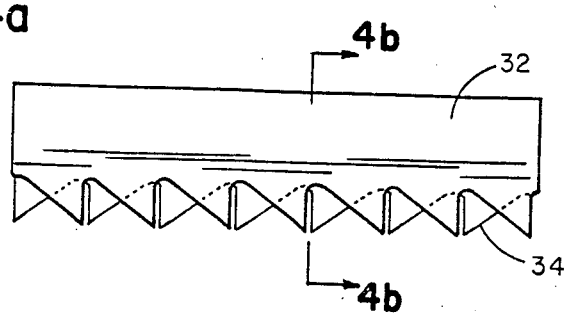
FIG 4b
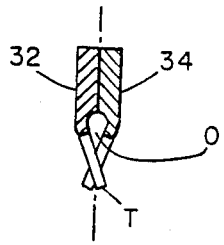
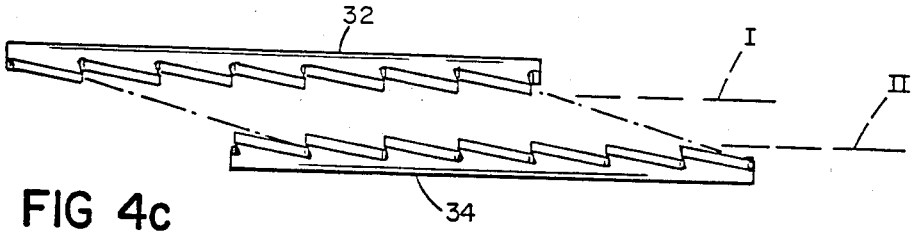
FIG 4c
FIG 4d
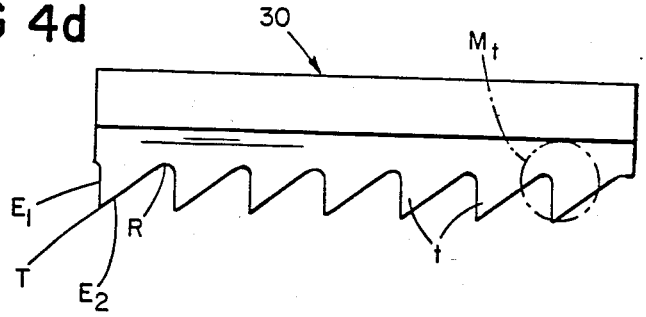
FIG 4e
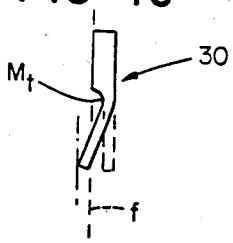
FIG 18
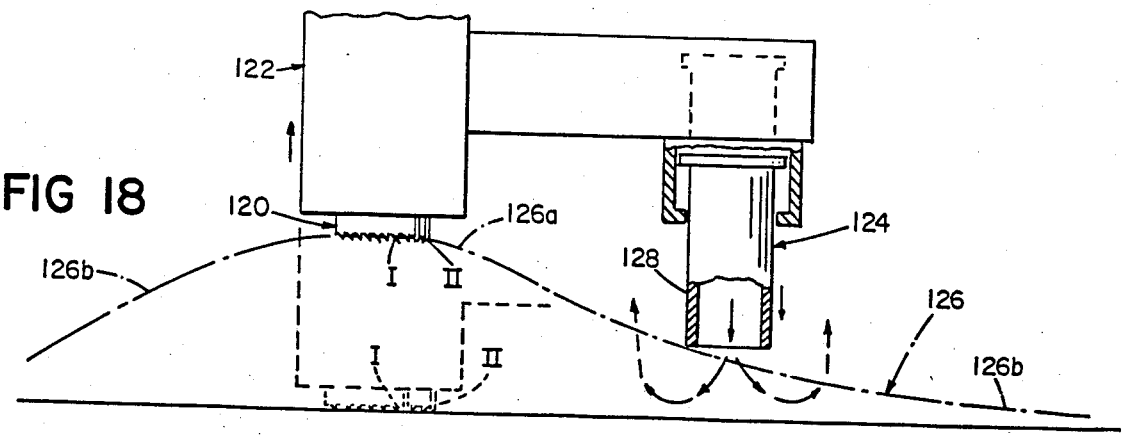

FIG 10
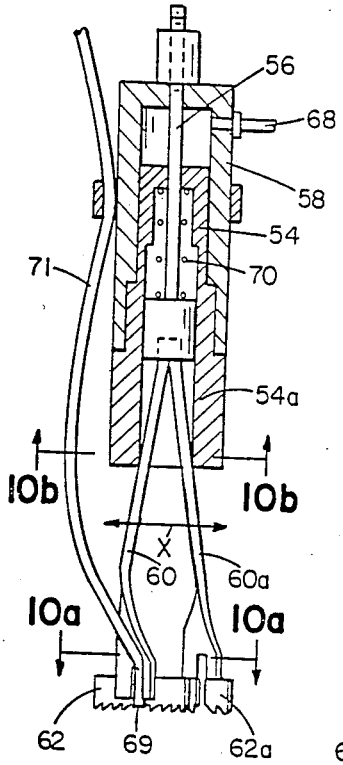
FIG 11
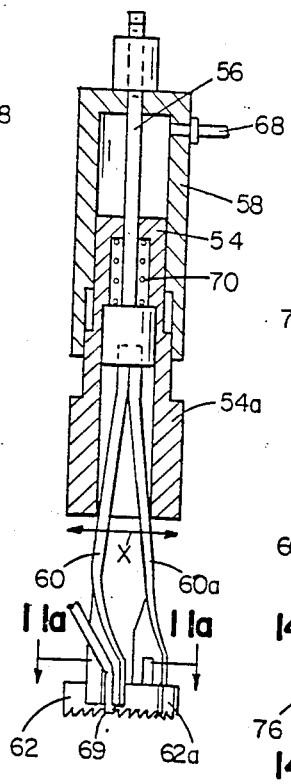
FIG 14
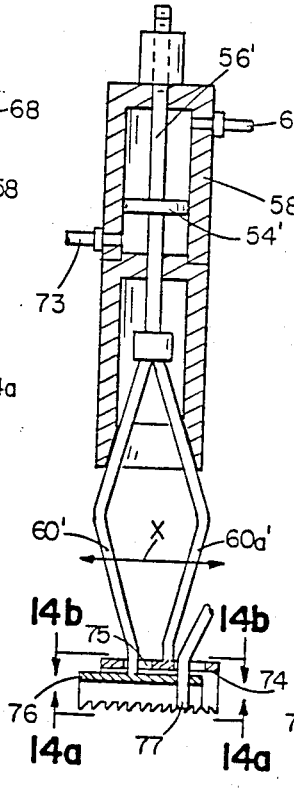
FIG 15
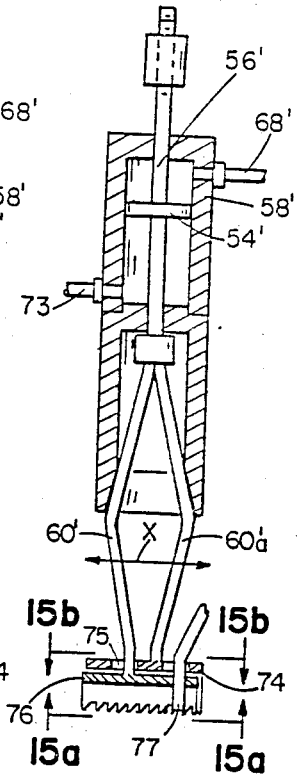
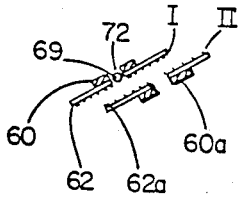
FIG 10a
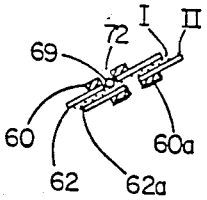
FIG 11a
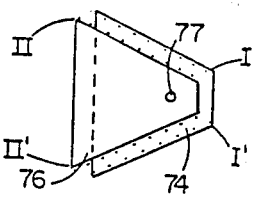
FIG 14a
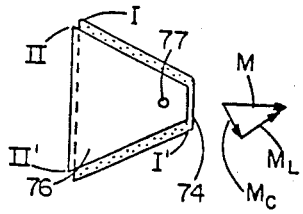
FIG 15a
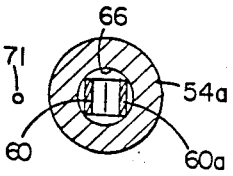
FIG 10b
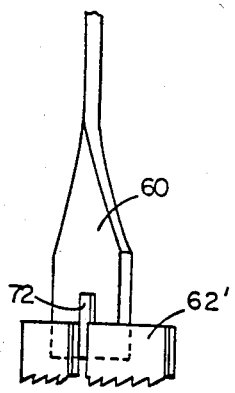
FIG 10c
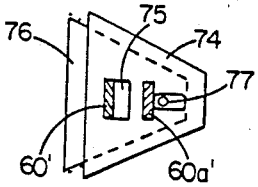
FIG 14b
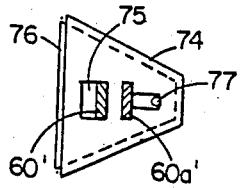
FIG 15b FIG 12
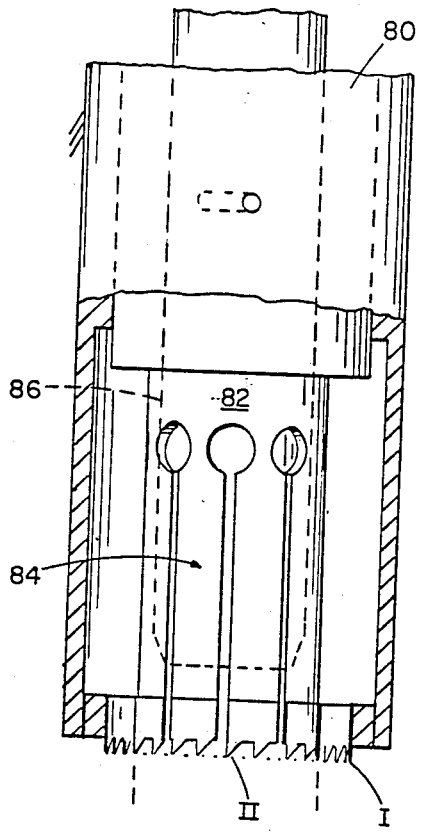
FIG 13
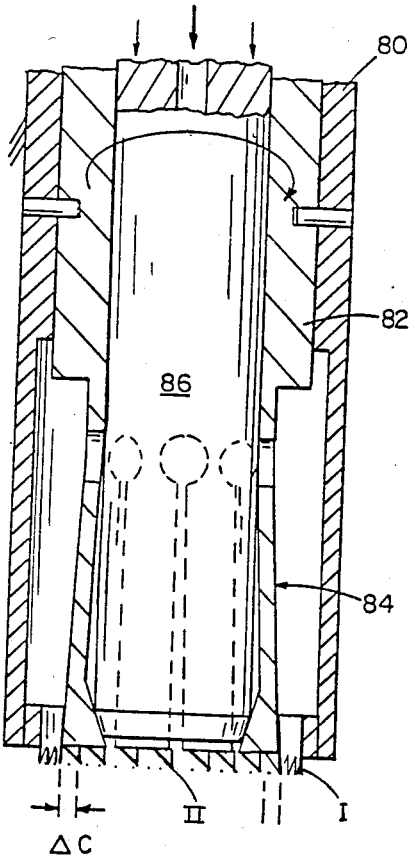
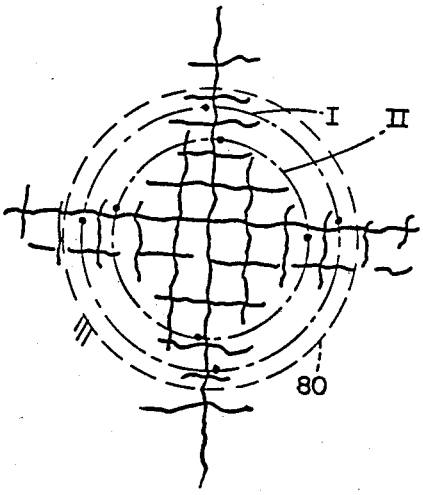
FIG 12a
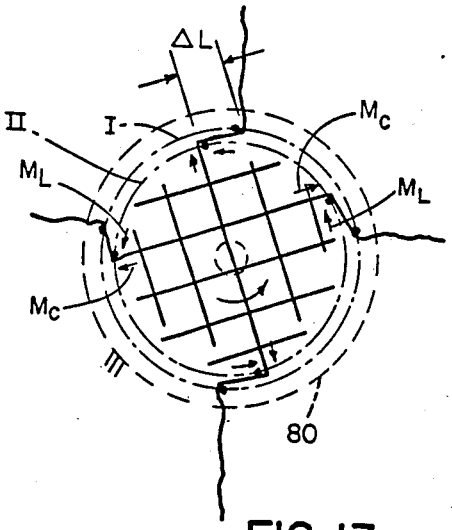
FIG 13a

FABRIC PICKUP AND THE LIKE

BACKGROUND

This invention provides a key step for the automation of the garment industry by the elimination of the need for manual pickup and handling of individual fabric layers. The invention has particular application to the separation of textile layers from a stack where the nature of the textile fabric may be different from one layer to the next.

For many decades the step of manual pickup has been a chief obstacle to automated manufacture of garments. It has long been possible to efficiently form a stack of identically shaped component pieces for a garment by simultaneous cutting with a fabric saw through a multiplicity of overlying layers, guided by a pattern. Likewise, accurate sewing together of the various components has been effciently accomplished as by use of automated platens and high speed sewing machines. The possibility of computer control in recent years has increased the speed of such techniques that already had been quite fast.

But between the steps of forming the stack and sewing together the individual pieces there has remained the tedious manual step of picking up individual pieces from a stack or other surface. The threads at the cut edges of the pieces, the limpness of the pieces, and the variation in their texture and other parameters from piece to piece, have together made the separation problem one of the chief obstacles to elimination of the slowness and expense of manual labor in the garment industry.

Our own work on this problem for more than a quarter of a century, as well as the work of numerous others, is testimony to the difficulties of the problem. Although we and others have been able to find ways to separate like pieces, and to show promising progress even with dissimilar pieces, the proposed solutions of the past work of ourselves and others have not been found acceptable by the industry.

Our prior designs are shown in U.S. Pats. Nos:

3,168,307, Walton et al, 1962;
3,369,803, Walton et al, 1968;
3,406,961, Walton, 1968;
3,406,966, Walton, 1968;
3,531,103, Walton, 1970;
3,813,094, Walton et al, 1974.

Examples of the work of others in the same or somewhat related fields are U.S. Pat. Nos.:

793,009, Miller, 1903;
1,649,319, Molyneux, 1927;
1,708,195, Kinney, 1930;
3,026,109, Pfeffer, 1962;
3,176,979, Engelmann, 1965;
3,291,480, Haddad, 1966;
3,253,824, Southwell et al, 1966;
3,353,821, Smith et al, 1967;
3,386,396, Jacobs et al, 1968;
3,386,763, Ottaway et al, 1968;
3,442,505, Szentkuti, 1969;
3,547,432, Herdeg, 1970;
3,550,932, Mason, 1970;
3,583,695, Sherwood, 1971;
3,588,091, Stone et al, 1971;
3,625,506, Rosin, 1971;
3,747,919, Stewart et al, 1973;

3,756,587, Lutts et al, 1973;
3,806,114, Carter, 1974.

This corpus of work represents an extensive, long term, diligent effort at use of needles and other gripping materials, tensioning and nipping motions, and air and vacuum assists, etc., aimed at this seemingly simple problem. Yet, the garment industry continues to move to those places in the world where manual labor can be afforded at lowest cost, one major reason being the need, as still recognized, to use hand dexterity for picking up and performing related operations on individual fabric pieces.

SUMMARY OF THE INVENTION

According to one aspect of the invention, the pickup device comprises first and second fabric gripping elements for a sheet-form flexible fabric piece and means for causing the elements to clamp the fabric characterized in that the elements move laterally in the plane of the fabric at an angle to the direction of clamping, whereby the fabric, when clamped, has previously been tensioned by the lateral motion. In many examples of use, the clamping forces are applied to a tension-produced gather or ridge in the fabric. In one use, the pickup device is positioned adjacent a stack support and arranged to repeatedly remove the exposed first piece from the stack.

In preferred embodiments, each of the fabric gripping elements provides gripping points arranged in matching lines, and the means for producing the relative movement is adapted to tension the fabric diagonally between the gripping elements and then to clamp the fabric at a line on the face of the fabric. In numerous instances, the points are in straight lines, while in others they are curved. In preferred embodiments, the gripping elements include opposed teeth that are matched to move together to clamp the fabric. In certain instances, space is provided adjacent the tips of the gripping elements to accommodate small folds of gathered fabric.

In one presently preferred embodiment of the invention each of the gripping elements comprises a straight support portion, these portions adapted to come together face to face when the fabric is clamped, each of these support portions having teeth that project outwardly from the edge of the support portion, when the support portions are together the tip of the teeth being close together and the base portions of the teeth being spaced from one another to accommodate gathered fabric. Preferably these gripping elements comprise saw blades that have been machined on the inner surface of the blade to reduce the thickness of the teeth relative to the body of the blade and the tips of the teeth are bent inwardly relative to the original plane of the blade. Preferably, the tips of the gripping elements extend inwardly beyond the inner face of the support portion to a position enabling entry in the space between teeth of the opposed gripping element.

According to another aspect of the invention, a pickup device comprises a pair of gripping elements adapted to move toward each other along the face of a piece of fabric to grip the fabric and separate it from an underlying piece or surface, wherein the gripping elements define teeth that have frontal surfaces that extend substantially perpendicular to the face of the piece to be picked up, and rearward surfaces that extend from points of the teeth at an acute angle to the face, the teeth being arranged so that the frontal surfaces are directed to advance along and disturb the piece to aid in pickup when the gripping elements move toward pickup position, said teeth being effective to grip said top piece without detrimentally contacting the second piece or surface.

According to another aspect of the invention, a pickup device comprises two gripping elements each comprising a line of teeth adapted to engage the face of a piece of fabric to be picked up, these lines being parallel, and means to move the lines of teeth toward each other along a path set at an acute angle to the direction of the lines of teeth to clamp a portion of the face of the fabric. Preferably, the alignment and spacing of the teeth and their direction of movement are adapted to cause respective teeth in the two lines to come together to clamp the piece of fabric, and in many instances, preferably the points of the teeth of one line are set in the direction of the other line of teeth, and are adapted to enter respective spaces between teeth of the opposite line to clamp the face of the fabric.

Another aspect of the invention is an apparatus which combines the pickup device described with means to blow a jet of air downwardly through the face of the piece in the vicinity of the gripping elements. In preferred embodiments of this apparatus, the gripping elements comprise aligned gripping points and the jet is produced along the line, between gripping points. In another preferred arrangement the jet is produced by a telelescopic tube or other device which follows the fabric to maintain the integrity of the air jet against the face of the fabric while the apparatus is lifted away.

In another aspect of the invention, pairs of the gripping elements are spaced from one another, the inside gripping elements of each of the pairs being movable outwardly away from each other in their motion toward the second of each of the pairs in the manner that the fabric between the operating pairs is tensioned. In this case it is advantageous to direct a jet of air through the tensioned portion of the fabric lying between the inner gripping elements during their motion, the tension produced by their motion serving to stretch open the pores of the fabric to allow air to pass relatively freely through the first piece of fabric.

In preferred embodiments the gripping elements of the pickup device are mounted on supports that are resiliently urged apart, and a camming means is arranged to force the supports together to produce the lateral and clamping motions. In such embodiments, preferably: the supports comprise a pair of elongated spring arms that are biased apart, the camming means being a member which slides along the oppositely directed outer surfaces of the spring arms to progressively squeeze them together; the elongated spring arms are arranged to move relatively in a predetermined lateral direction between open and closed positions and each of the gripping elements comprises a set of points conforming to the plane of the face and set at an angle to the predetermined lateral direction; and the elongated spring arms are arranged to extend parallel to the face of the piece of fabric.

In other preferred embodiments one gripping element is fixed and supported by a frame, and the other element is movably supported by the frame, preferably the movable element is slidably mounted on guides defining the the two components of motion, more preferably the fixed frame defines guide slots in which the movable element is engaged for defining its motion, or the movable element is supported on pivotal links to the fixed element. In certain preferred embodiments, there are two pairs of gripping elements, the fixed frame defines outer elements of the pairs, and the movable elements lie within the frame and have an air piston and cylinder arrangement disposed therebetween, expansion of the piston and cylinder arrangement being effective to simultaneously spread the inner elements apart towards their respective fixed elements. In other preferred embodiments, the gripping lines are concentric circular lines, one of the lines being defined by a flexible member, and means are provided for enabling the flexible member to deflect gradually during circular motion whereby the elements close together while being displaced laterally.

In certain preferred embodiments the relative motion between fabric gripping elements begins at a displacement angle between about 20° and 45°, relative to the perpendicular to the gripping elements.

A fabric handling apparatus of the invention comprises an array of the described pickups disposed at opposite edges of the piece of fabric, and means to rotate the array of pickups about a horizontal axis to turn the piece of fabric upside down and means to rotate the pickups about a vertical axis to turn the piece of fabric end for end, preferably the horizontal version of the pickup being employed.

According to another aspect of the invention, a pickup apparatus for removing a single piece of fabric from a stack comprises means for clamping and applying tension to a first piece of fabric on the top of a stack of pieces, and means for directing a flow of air against and through the clamped, tensioned first fabric piece, whereby the application of substantial tension to the first piece, permitted by the clamping, increases the open area of the fabric for flow of the air therethrough, the air thereby impinging upon the surface of the next underlying piece to facilitate separation of the first piece from the remainder of the stack.

In preferred embodiments of this aspect of the invention, the means for applying tension comprises spaced apart fabric gripping elements, and means for producing relative movement between the elements to apply tension to the fabric; preferably the means for producing relative movement of the fabric gripping elements is constructed and adapted to produce motion whereby the fabric lying between the gripping elements is tensioned by a lateral displacement of the gripping elements and the fabric is clamped by a closing motion.

We turn now to the structure and manufacture of the preferred embodiment, first briefly describing the drawings.

DRAWINGS

FIGS. 1, 1*a*, 2, 2*a* and 3, 3*a* comprise three successive illustrative sets of views of gripping elements according to the invention at successive stages of position during their action, shown greatly magnified in size;

FIGS. 3*b* and 3*c* show the relative porosity of untensioned and tensioned fabric, respectively;

FIG. 4 is a top view of a preferred construction in which the movable element slides on stationary guides which are angled relative to the line of the stationary element;

FIGS. 4*a*, *b*, and *c* are side, end and bottom views respectively of gripping elements useful, e.g., in the embodiments of FIGS. 4, 5, 10, 10*c*, 14 and 16, comprising matched teeth; FIG. 4*d* and 4*e* are side and end views of a single element illustrating steps in its manufacture;

FIGS. 5 and 5*a* are bottom and top views respectively of another preferred embodiment employing two sets of linear gripping elements, the inner elements of the two sets being adapted to move apart from one another;

FIGS. 6, 6*a;* FIGS. 7, 7*a;* FIGS. 8, 8*a* and FIGS. 9, 9*a* are sets of views illustrating the action of the pickup device of FIG. 5;

FIG. 10 is a cross-sectional side view of a preferred construction in which the gripping elements are carried on cam-driven spring arms, shown in their open position, while FIG. 10*a* depicts the relationship of the gripping elements to the fabric piece and FIG. 10*b* is a cross-sectional view taken on line 10*b*—10*b* of FIG. 10;

FIG. 10*c* is a side view of another preferred gripping element useful in the embodiment of FIG. 10;

FIG. 11 and 11*a* are views similar to FIGS. 10 and 10*a,* respectively, showing the gripping elements in closed position.

FIGS. 12, 12*a* and 13, 13*a* are sets of figures during the operation of another embodiment in which the gripping elements are disposed on curved lines;

FIG. 14 is a view similar to FIG. 10 of a cam-driven unit which carries two pairs of gripping elements, the pairs set at an angle to one another while FIG. 14*a* and 14*b* are views looking up and down along lines 14*a* and 14*b* of FIG. 14, respectively;

FIGS. 15, 15*a* and 15*b* are views similar to FIGS. 14, 14*a* and 14*b,* showing the gripping elements closed together;

FIG. 16 is a plan view of a pick-up unit similar to that of FIG. 10 but arranged with its body horizontally rather than vertically while

FIG. 18 is a diagrammatic side view of a pickup apparatus which incorporates a telescopic air jet device.

PREFERRED EMBODIMENTS

Figure 3B:
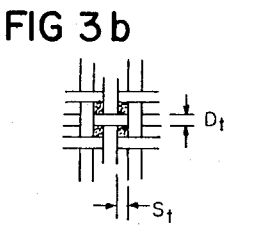
Figure 3C:
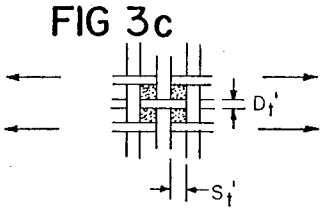
Figure 3A:
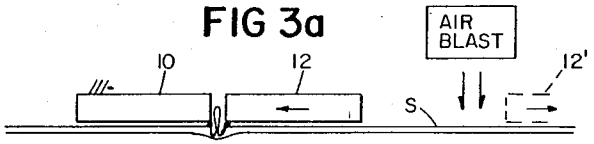
Figure 3:
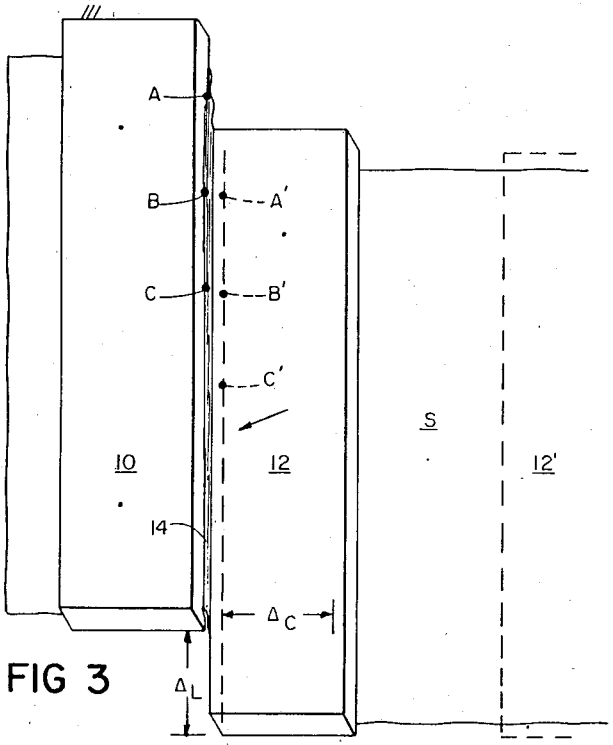

Referring now to FIGS. 1, 1*a,* FIGS. 2, 2*a,* and FIGS. 3, 3*a,* straight fabric gripping lines I and II are defined by spaced apart points on stationary and movable elements 10 and 12, respectively. Gripping lines I and II lie in the plane of fabric piece 14, may be between $\frac{1}{8}$ and $\frac{1}{2}$ inch long, and are defined for instance by card clothing points arranged in a plane vertically, see FIG. 1*a,* with the angle of the points sloping in different directions respectively for the two gripping lines.

In the initial position of FIG. 1, the two gripping lines I and II are shown parallel. For purpose of illustration arbitrary points are designated along the two elements which are directly opposed to each other, pairs of points A, A′, B, B′ and C, C′.

Means are arranged to cause lateral displacement motion $M_L$ and closing motion $M_C$. For illustration purposes, the motions of member 12 through the series of FIGS. 1, 2 and 3 are depicted to be combined in the nature of the component motions of a parallel rule device used by draftsmen when making drawings. The parallel links 130 of such a device cause the motion to be predominantly lateral at first, when the connecting links lie at substantial angles to lines I and II; then as the links approach being parallel with lines I and II, the motion is predominantly a closing motion.

FIG. 2 shows an intermediate position of the movable gripping line II in which displacement $\Delta_L$ has occurred in the direction parallel to lines I and II and the elements have been closed together by a relatively insignificant amount $\Delta_C$. In this position it is seen that points A′, B′ and C′ have been displaced diagonally relative to their mating points. At the same time the rectangle of cloth bounded in FIG. 1 by points A, A′, C′ and C has been distorted to a diagonal shape that has less area than the original rectangle, and the cloth has assumed a slightly ridged or pleated condition. The direction of extent of the pleats indicated by dashed line P in FIG. 2*a,* lies at an angle to lines I and II less than the angle to I and II now formed by the line between points A′, A. The cloth is under significant tension as a result of the lateral displacement $\Delta_L$.

The degree of lateral motion to be employed as dependent upon the nature of the particular fabric. For instance, in the case of FIGS. 1–3, for knitted fabrics having considerable elongation, the angle a of initial motion as shown in FIG. 1 may be quite acute, e.g. 20° or less, with a significantly large initial increment of lateral displacement and minimal closing displacement. On the other hand, with fabrics having little elongation, for instance tightly woven fabrics, the angle a of intial motion may be significantly larger, up to about 45°. Also, while it is presently preferred that mechanical means define the degree of motions throughout their range, in certain circumstances it is possible for the fabric itself to be involved in defining the motion, for instance, it is possible to sense the tension being applied between the movable and fixed gripping elements, and to vary the ratio of lateral to closing displacement, during closing motion, to maintain a constant degree of tension.

Progressing from the position of FIG. 2 to FIG. 3, the pleated material is nipped or clamped between the closing elements. The net result of the action depicted in FIGS. 1–3 is to effect a positive grip on the top fabric piece in a stack, without harm to the top piece and while creating conditions that decrease the tendency for any second piece of fabric to follow the first. Much of the problem in the separation of the top piece from a stack without disturbing the second piece arises from fiber engagement between the two pieces. However, when the top piece is placed under significant tension, its frictional engagement with the second piece is decreased and it more readily slides over the face of the stack without disturbing the stack. Furthermore, there may occur somewhat of a wedging action in the nip between the two gripping elements as they close together; the accumulation of pleated material of the first piece between the elements tends to press downwardly and to exclude the second piece.

The condition of FIG. 3 is normally reached before the top piece is taken away.

Figure 17:
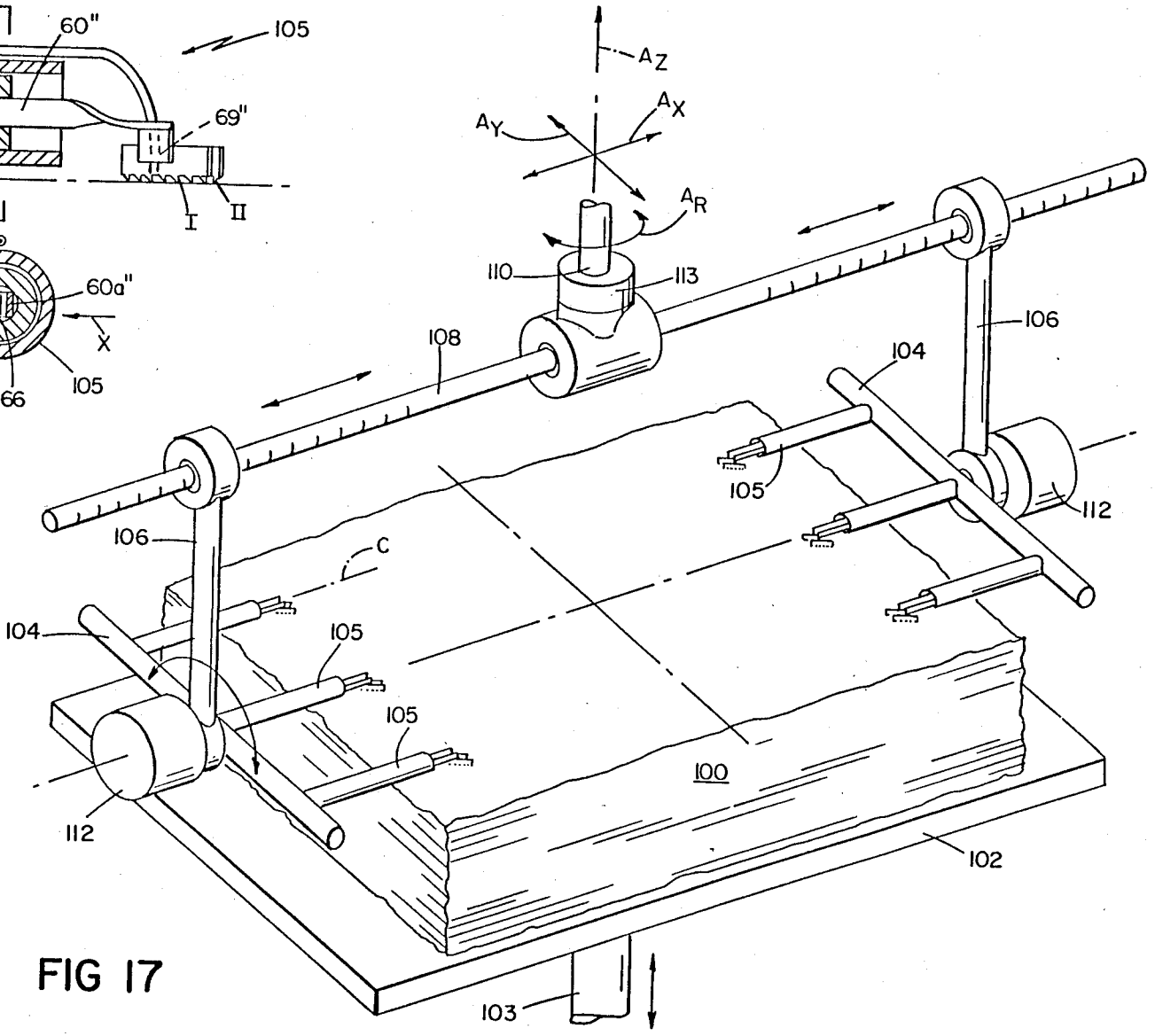
FIG. 17 is a diagrammatic perspective view of pickup unit employing a number of the pickup devices of FIG. 16 in an arrangement which enables turning over, turning end-for-end and translation of a fabric piece that has been picked up.

After the closing motion is completed as depicted in FIG. 3, with the entire rectangular area bounded by A, A′, C′ and C, FIG. 1, compressed into the very small area represented by A, A′, C′, C in FIG. 3, then the pickup device may be lifted or a stack (100, FIG. 17) on which it rests may be lowered, to remove the top piece from the stack. Then the apparatus may be moved to deposit the piece, e.g. on to a conveyer or into a slot or other receptacle or platen, to enable automated formation of the garment without the pieces ever being touched manually from the stack to the finished garment.

To enhance the operation just described, a jet blast of air can advantageously be employed. In one form of the invention, two sets of the clamping elements are employed as suggested in FIG. 3. The inner element 12' of the second set moves away from the inner element 12 of the first set to subject the intervening span S shown in FIG. 3*a* to tension. Referring to FIGS. 3*b* and 3*c*, the effect of the high tension that can be achieved by the positive grip is shown. In the untensioned state (FIG. 3*b*), the threads in both direction have equal spacing $S_t$ and the thread diameters $D_t$ are equal. A typical open area between the threads, (darkened in the figures for clearer reference) is relatively small, with limited porosity. When tension is applied, as indicated by the arrows in FIG. 3*c*, the diameter $D'_t$ of the threads lying parallel to the direction of the tensioning force is reduced, and the spacing $S'_t$ between these threads that lie perpendicular to the force is increased. The open area, again darkened, and hence the porosity of the fabric, is increased. An air blast directed at the surface of the relatively porous top tensioned fabric passes readily through and presses on the surface of the untensioned underlying layer which therefore presents a relatively large frontal area to receive the air blast. This creates a relatively high static pressure condition above the second layer. The effect is to press the second layer against the stack, increasing its frictional engagement with the third layer, thus unifying the remainder of the stack and further decreasing the possibility of disturbing the stack during the removal operation. It is to be noted that this air blast can be applied soon after motion of elements 12 and 12' begins; the intensity of the air jet may be increased when the clamped condition of FIG. 3 is reached.

Figure 4:
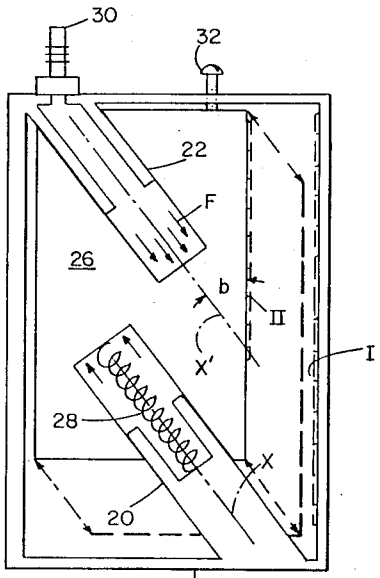

In the embodiment of FIG. 4 stationary guide tubes 20 and 22, shown diagrammatically, set at an acute angle b to line II, are permanently secured to fixed frame 24. Fixed frame 24 defines stationary linear web-gripping element I. A block 26 having holes receiving the stationary tubular guides 20 and 22 is slidably mounted to reciprocate between the solid line position and dashed line positions shown. A compression spring 28 urges the block 26 to the solid line open position while an air inlet 30 permits the selective application of compressed air through tube 22. Stop 32 adjustably establishes the initial open position of block 26. When the compressed air is applied, forces F urge body 26 to slide along parallel axes X and X' to simultaneously close and displace laterally relative to the fixed element. As shown in FIG. 4*a*, the two cloth fabric-gripping elements I and II are comprised of card clothing whose inclination of teeth are inclined in opposite directions to one another. This has the effect that during lateral displacement, the card clothing can positively grip the cloth piece, while by reverse motion of the block, the piece can be released, e.g. to drop it on a conveyer.

FIGS. 4*a*, *b* and *c* illustrate a preferred form of gripping elements.

Referring to FIGS. 4*d* and 4*e*, a band saw blade 30 of, e.g., 14 teeth per inch is first milled at $M_B$ to reduce the thickness of the teeth, t, and the root region, R. When this is complete the teeth have the shape shown in the dotted lines of FIG. 4*e*. The teeth are collectively bent toward the side from which the material has been milled, preferably the tips being bent beyond the face plane, f, of the blade.

Referring back to FIG. 4*d*, the frontal edge surfaces $E_1$ of the teeth are substantially vertical to the tips T of the teeth, t. The trailing edge surfaces $E_2$ extend from the tips T at an acute angle. This special shaping of the teeth is found to be important in limiting the penetration of the top piece, a particularly important feature when the top piece is to be removed from a stack of pieces. When the gripping elements 32 and 34 close together, the frontal surfaces $E_1$ face in the direction of motion and engage the face of the material to produce the gathers or pleats that have been mentioned. It is found that the substantial vertical nature of these frontal surfaces tends to limit penetration through the top piece, due to the blunt non-wedging nature of the frontal surface.

Two of these blade-form members 32, 34 are mounted in the pickup apparatus in the manner suggested in FIGS. 4*a*, *b* and *c*. Thus the teeth take the dashed line paths of FIG. 4*c* as they close together, and in their final motion, for certain fabrics, they preferably intermesh as shown in FIG. 4*b*, with points T of the teeth entering the space between teeth of the opposing line, thus to obtain an exceedingly strong grip on the fabric. Meanwhile the opening, O, provided by the milled away region, $M_t$, on each element accommodates tension-produced gathers or ridges in the fabric and thus allows the points of the teeth to come together as described.

When so gripped, the pickup devices may be subjected to vibrations, twisting, sudden movements, various blasts of air and other actions for the purpose of aiding in the separation of the piece of fabric from a stack, or in orienting or treating the fabric. The firm grip afforded by the intermeshed teeth can withstand very vigorous action in this regard.

For certain fabrics, other arrangements are of course possible. The frequency of teeth and their length are chosen with regard to the nature of the fabric, e.g., whether coarsely or finely woven or knitted, the nature of the substance from which the fabric is made and the forces to which the piece are to be subjected. In general, the motion of the present invention makes it readily possible to select gripping elements which do not detrimentally pierce a piece of fabric, e.g. when the piece is to be removed from a stack.

Figure 5:
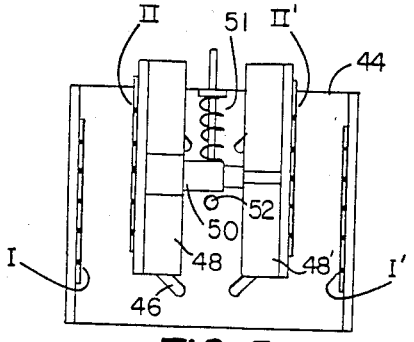
Figure 5A:
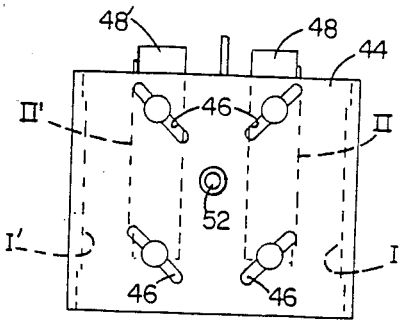

Referring now to the further embodiment of FIG. 5, a stationary frame 44 defines stationary fabric-gripping lines I and I'. Slotted guides 46 are provided in the stationary frame and serve to guide moving elements 48 and 48'. An air piston arrangement 50 is disposed between the two elements, enabling simultaneously motion of the two along their respective guides while a compression spring 51 serves to return the movable elements to their open position upon the termination of the application of compressed air to the unit.

Figure 6:
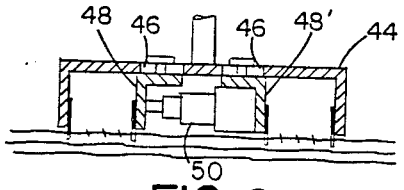
Figure 6A:
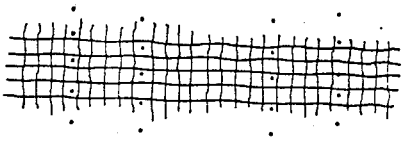
Figure 7:
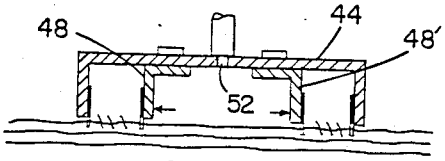
Figure 7A:
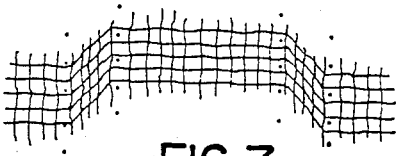
Figure 8:
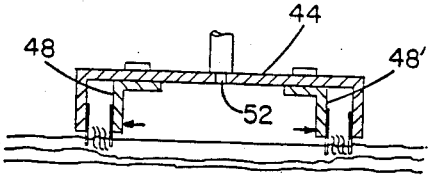
Figure 8A:
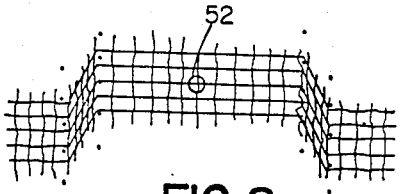
Figure 9:
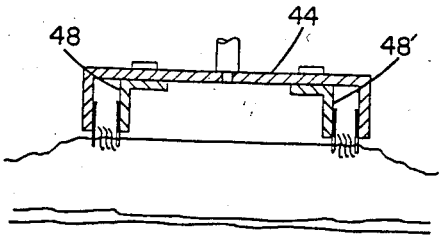
Figure 9A:
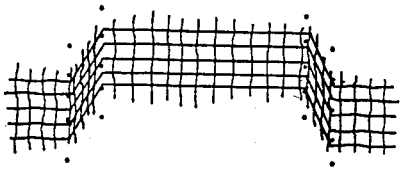

FIGS. 6–8 show the sequence of operation of the embodiment of FIG. 5. In FIG. 6, the fabric gripping lines are engaged upon the top piece of fabric in the stack. FIG. 6*a* shows (representatively) the fabric with the points of engagement. Moving to FIG. 7, air piston arrangement 50 has been activated to move elements 48, 48' toward lines I, I', respectively as indicated by the arrows. As shown in FIG. 7*a* and further in FIG. 8*a*, this action stretches the center section of the fabric between elements 48, 48', increasing the open space, and hence the porosity, of the fabric. An air blast from nozzle 52 passes through the stretched fabric to impinge upon the surface of the underlying sheet to hold it in place as the gripped top sheet is removed. In FIG. 8, the movable and stationary elements have clamped the tension-produced pleats in the sheet and in FIG. 9, the sheet is lifted separately from the stack.

In the further embodiment of FIGS. 10 and 10*a*, an air-driven piston 54 is mounted to travel along guide rod 56 within vertical cylinder 58. Upper end of rod 56 serves to connect the device to its support. A lower extension of the guide rod 56 carries a pair of elongated, downwardly, outwardly flared spring arms 60, 60*a* which extend downwardly to pick-up elements 62, 62*a* in the form of planar segments of a band saw blade, as described in FIG. 4*a* et seq. A lower extension 54*a* of piston 54 defines an inner cylindrical camming surface 66 which engages the oppositely directed outer surfaces of the arms 60, 60*a*. When compressed air is applied through inlet 68, piston 54 moves from the position of FIG. 10 to the position of FIG. 11 causing camming surface 66 to ride downwardly on the outward flared arms 60, 60*a* and press them together. The gripping lines of elements 62 and 62*a* are set in the horizontal plane at a 45 degree angle to the direction of camming movement of the arms, arrow x. Because of this angular orientation, the lines I and II defined by the gripping elements 62, 62*a*, in moving from the spaced apart position of FIG. 10*a* to the clamped together position of FIG. 11*a*, translate laterally as well as move close together.

When the air pressure at inlet 68 is relieved, spring 70 forces the piston 54 upwardly, back to the position of FIG. 10, while the arms 60 and 60*a*, due to the upward movement of the cam surfaces, are given freedom to spring apart. Thus the gripping elements are moved from the position of FIG. 11*a* back to the position of FIG. 10*a*.

The gripping elements 62 and 62*a*, of length, e.g. of $\frac{1}{4}$ to $\frac{3}{8}$ inch, may have a uniform distribution of points along their length as shown in FIG. 4*a* et seq. or may, as shown in FIG. 10, have a number of points at each end and a central relieved region at which there is no engagement with the fabric. In the plane of one of the gripping elements in FIG. 10, a downwardly directed air jet tube 69 is secured, supplied by compressed air line 71.

The operation of the embodiment of FIGS. 10 and 11 upon a fabric piece will now be described.

The pickup device is lowered to the face of a piece of fabric to be picked up, e.g. the top piece of a stack. When the gripping lines I and II engage the face of the fabric, activating air pressure is applied through inlet 68 causing the piston extension 54*a* to move down, while the gripping element 62 and the cylinder remain at their original levels. Camming surface 66 thereby closes arms 60, 60*a* together, causing the gripping lines I and II, which are set at an angle to the cammed motion, to move laterally and close together. As soon as the camming action begins, compressed air is applied through supply line 71 via the air tube 69 to direct a jet of air against the face of the fabric in the middle of one of the gripping lines. It is found that the gripping achieved by the gripping elements is so secure that this jet of air does not blow off the fabric piece. Instead, the jet penetrates the gripped top fabric piece, and helps to stabilize the remainder of the stack.

When the gripping elements have achieved the position of FIG. 11, the pick-up device along with any others that have engaged the fabric piece are moved relatively away from the stack, carrying a gripped fabric piece. During this time, activating air pressure is maintained on inlet 68 to keep the gripping arms 60, 60*a* closed together. For a short distance pressure is also maintained on jet supply line 71 for the purpose of pushing down a second piece should one tend to be carried up with the first piece. Air pressure on jet line 71 may be discontinued soon during travel from the stack, but air pressure is continuously applied to activating inlet 68 until it is desired to release the piece of fabric. When the pickup device has been moved to the position for release, the air pressure on line 68 is relieved. As piston extension 54*a* is returned upwardly by spring 70. The arms 60 and 60*a* spring apart, causing the gripping elements to disengage, and allowing the fabric piece to be deposited. During this release period, pressure can again be applied to jet blow-down line 71 to assist the release of the fabric piece from the pickup device.

It has been found advantageous to provide the gripping element 62 in segmented form as shown in FIG. 10*c*, so that each end of the gripping element has independent flexibility. In the embodiment shown, the gripping element 62' is comprised of a short length of band saw blade which is secured by soldering face-to-face with the end of arm 60, which may be a pre-bent strip of blue spring steel of 0.030 inch thickness and 3/16 inch width. A central vertically extending slot 72 e.g. of 0.032 inch width is milled through the thickness of the blade and the end of the arm 60, and upwardly along the arm for a distance, e.g. 1/16 inch, to render the ends of the gripping element free to independently flex. It has been found in certain instances that this resiliency helps in achieving a good grip on the fabric piece, as in the presence of substantial variation in the nature of the fabric, as may occur due to a decorative knot or other surface variation.

In the embodiment of FIGS. 12 and 13 the fabric gripping lines are circular in form, provided by concentric cylinders 80, 82. The inner cylinder is slotted at spaced intervals to form spring arms 84 that are capable of radial deflection. In some instances, where the thickness of the tube and frequency of the slots is sufficient, the elements can respond to the tension of the cloth to deflect outwardly into a cloth-nipping position. In other elements a positive camming member, for instance the camming rod 86, as shown in the figures, is employed. In the retracted position (FIG. 12) the camming rod 86 applies no force to the inner member, and the inner member is cylindrical and significantly spaced from the outer member. When the camming rod 86 is displaced downwardly to a position shown in FIG. 13, it forces the spring fingers outwardly by a distance $\Delta_C$ to the nipping position. This motion is accompanied by rotational motion of the inner member by a distance $\Delta_L$ so that both the closing component of motion $M_c$ and the displacement component of motion $M_L$ occurs. The fabric is displaced in the way shown diagrammatically in FIGS. 12*a* and 13*a* to effect results similar to those previously described. An air jet may be directed upon the tensioned fabric lying within the circle of the inner element, as suggested in the figure.

The embodiment of FIG. 14 carries two pairs of gripping elements while being activated in a manner similar to that of FIG. 10. Referring to FIGS. 14 through 14*b*, the two elongated arms 60' and 60*a'* and connected to piston 54' which is surrounded by moving cylinder 58' activated by compressed air introduced to inlet 73'. For the return stroke of the device, instead of the spring of FIG. 10, compressed air is applied through inlet 68 to the reverse side of the piston. Secured to the end of one arm 60' is upper frame 74 of triangular form, having along its two edges depending skirts that define gripping lines I and I' which are set at an acute angle to each other. The other spring arm 60*a'* extends through a slot 75 in the upper member and supports lower member 76. This member has depending portions which define inner gripping lines II and II', parallel to gripping lines I and I' respectively. As shown in FIGS. 14 through 14*b*, with the cylinder in its upper position the spring arms are allowed by the camming surface 66' to spread apart, thereby holding apart the pairs of gripping lines. Upon the application of air pressure to inlet 73' the cylinder is pushed down, forcing the legs together and causing the two pairs of gripping elements to move in direction M with components of lateral motion $M_L$ and clamping motion $M_C$. Between the two pairs of gripping elements an air outlet 77 is provided for directing a jet downwardly against the stack through fabric that has been tension by the opposite movement of the two inner gripping elements.

The devices that have been described are useful along the edges of stacks. Often it is advantageous to provide supplemental devices to assist in holding down the stack while the gripped top layer is being pulled away. In some instances further jets of air can be employed, sometimes spaced substantially from the gripping elements. In circumstances where the air jet is directed against a portion of the fabric that tends to droop behind the portion that is engaged and being lifted by the pickup, it is advantageous that the means directing the air jet stay close to the stack during the initial take away movement of the pickup, see FIG. 18.

Another advantageous provision is a finger device which, after initial raising of a corner or an edge of a fabric piece by the pickup of the invention, can enter between that piece and the remainder of the stack and press down upon the stack, thereby to help to hold the stack in place while further removal motion occurs.

Figure 16A:
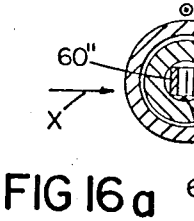
FIG. 16*a* is a cross section taken on line 16*a* of FIG. 16.
Figure 16:
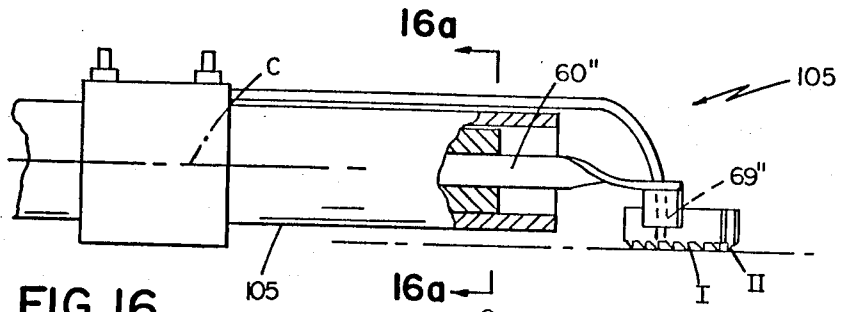

The embodiment of FIG. 16 is identical to that of FIG. 10 except the unit is turned so that the axis C of the activating cylinder is horizontal, parallel to the top of the stack while the gripping element edges I, II are turned so that they lie parallel to axis C and so still engage the face of the stack in the desired lines. In this configuration, the spring arms 60'', 60*a''* are cammed together in the direction parallel to the face of the stack, in direction X in FIG. 16*a*, so that gripping lines I and II have the same motion as they do with the device of FIG. 10.

This arrangement has a low profile that in some instances enables desired movement into restricted areas. An example is given in FIG. 17. In this embodiment the stack 100 is disposed upon the elevator platen 102 which is raised up and down by piston 104. A series of the pickup devices 105 according to FIG. 16 are mounted on a crossways-extending support arm 104 and the same arrangement is provided at the opposite edge of the stack. These cross arms are supported in their center by vertical arms 106 which in turn are supported by horizontal, longitudinal rod 108 which extends the full length of the stack. This rod is supported in its center from above by vertical rod 110. Vertical rod 110 carries the weight of the assembly and is adapted to rotate in the direction of the arrow $A_R$ and to translate in the directions of arrows $A_X$ and $A_Y$ and $A_Z$. The cross arms 104 at opposite sides of the stack are rotatably mounted to arms 106 and are respectively driven by stepper motors 112. The radial length of cross arm 104 from center support to outer end is less than the length of rod 106 to permit rotation of rod 104 without interference with longitudinal support 108.

In operation of this assembly, the entire apparatus is moved down upon the stack, or the stack is raised by the elevator so that the working ends of the pickups engage the top layer of the stack. The activating air is applied to each of the pickups and the top layer is grasped while jets of blow-down air are applied through tubes 69'', FIG. 16. When the grasping motion is completed, the apparatus is raised or the elevator is lowered so that the single piece remains supported in mid-air. At this stage a controller determines what further motion the fabric will have. Where it is desired to turn the fabric piece upside down the stepper motors 112 at the two ends of the assembly are activated to rotate 180 degrees, thus rotating the top sheet. Where it is desired to reverse the top piece end for end, vertical support 110 is driven by stepper motor 113 to rotate 180 degrees in the direction of arrow $A_R$, thus rotating the rod 108 and the entire assembly. Translation of the piece in directions $A_X$ and $A_Y$ can be accommodated by translating the support rod 110 or in certain instances by moving the vertical rods 106 in the same direction simultaneously along support arm 108 as by high speed translational devices such as are used to move the printing ball of electric typewriters. When the desired motions have been achieved the device then may deliver the piece to be further processed.

Referring to FIG. 18 a pickup apparatus includes pickup 120 mounted on frame 122 which also carries air jet device 124 near the edge of the piece 126 spaced from the pickup device.

The pickup apparatus is brought to the dotted line position at the face of piece 126 and is activated to move the gripping lines I and II and to initiate the air jet.

After gripping the piece, separation movement occurs, either the apparatus rises or the support for the piece moves down. In so doing, the portion 126*a* of the fabric piece engaged by lines I and II is raised relative to the free portion 126*b*. Effectiveness of the air jet to penetrate the free portion is achieved by telescopic inner tube member 128 which drops during the initial separation movement in response to the air pressure acting on the upper end of the tube. The lower end of this tube therefore stays close to the top piece. It thus shields the air stream from mixing with ambient air, whereby the integrity of the air jet is preserved and its high fabric-penetrating velocity is maintained until it impinges on the top piece. The jet itself in cooperation with the rising pickup can tension the top piece of fabric and open its pores to enhance the passage of air through it to assist in the separating action.

The device may be positioned so that as the pickup device 10 rises it pulls the free edge 126*b* of the fabric piece out from under the jet. When this occurs, the jet can impinge on the underlying stack and produce a stabilizing force that further assists the separating action.

The gripping elements can be pivotally interconnected, for example by arms 130 indicated in dash line in FIG. 1.

Numerous other embodiments are within the scope of the invention.

We claim:

1. A pickup device for a piece of sheet-form flexible fabric or the like comprising:

first and second fabric gripping elements, and means for producing relative movement of said fabric gripping elements in a direction generally toward each other in a manner to cause the gripping elements to clamp the fabric, characterized in that said device has means adapted to move said gripping elements laterally in the plane of the fabric, at an angle to said direction to tension the fabric, whereby the fabric when clamped has previously been tensioned by lateral motion of said gripping elements.

2. The pickup device of claim 1 positioned adjacent a stack support and arranged to repeatedly remove a tap piece from the stack.

3. The pickup device of claim 1 characterized in that said gripping elements are specially shaped to accommodate and clamp a tension-produced ridge or gather in the face of the fabric.

4. The pickup device of claim 1 wherein teeth on the first gripping element are matched in opposition to respective teeth on the second gripping element, against which they clamp the fabric.

5. The pickup apparatus of claim 4 wherein teeth of said first and second gripping elements are adapted to enter into spaces between teeth respectively of the second and first gripping elements as they clamp the fabric.

6. The pickup device of claim 1 wherein each of said fabric gripping elements provides gripping points aligned essentially in a straight line, and said means adapted to move said gripping elements is constructed to provide movement that tensions said fabric diagronally between said gripping elements and then clamps the fabric along an essentially straight line at the face of the fabric.

7. A pickup apparatus including the device of claim 1 in combination with means to blow a jet of air downwardly through the face of said fabric in the vicinity of said gripping elements.

8. The pickup apparatus of claim 7 in which said gripping elements comprise gripping points substantially aligned in a line and said jet is produced along said line between gripping points.

9. The pickup apparatus of claim 7 in which said jet is produced by means which moves relative to said gripping elements to maintain the integrity of the air jet close to the face of the fabric while the gripping elements are lifted away.

10. The pickup device of claim 1 comprising pairs of said gripping elements spaced from one another, the inside gripping elements of each of said pairs being movable outwardly away from each other in their motion toward the mating member of their pair in the manner that the fabric between the operating pairs is tensioned.

11. The pickup device of claim 10 including means for directing a jet of air through the tensioned portion of the fabric lying between said inner gripping elements, the tension produced by said gripping elements serving to stretch open the pores of said fabric to allow air to pass relatively freely through said piece of fabric.

12. The pickup device of claim 1 wherein said gripping elements are mounted on supports that are resiliently urged apart, and a camming means is arranged to force said supports together to produce the motion of said gripping elements.

13. The pickup device of claim 12 wherein said supports comprise a pair of elongated spring arms that are biased apart, said camming means comprising means slidable along the oppositely directed outer surfaces of said spring arms to progressively squeeze them together.

14. The pickup device of claim 13 wherein said elongated spring arms are arranged to move relatively in a predetermined lateral direction between open and closed positions and each of said gripping elements comprises a set of points conforming to the plane of said face and set at an angle to said predetermined lateral direction.

15. The pickup device of claim 14 wherein said elongated spring arms are arranged to extend parallel to the face of said piece of fabric.

16. The device of any of claims 1–6 wherein one of said gripping elements is fixed and supported by a frame, and the other of said elements is movably supported by said frame.

17. The device of claim 16 wherein said movable element is slidably mounted on guides defining lateral and clamping motion substantially in the direction of the plane of the fabric.

18. The device of claim 16 wherein said movable element is supported on pivotal members.

19. The device of claim 16 in the form of two pairs of said elements, the fixed frame defining outer elements of said pairs, the movable elements lying within said frame and having an air piston and cylinder arrangement disposed therebetween, expansion of said piston and cylinder arrangement effective to simultaneously spread said inner elements apart towards their respective fixed elements.

20. The device of any one of the claims 1–6 wherein said gripping lines are concentric circular lines, one of said lines being defined by a flexible member, and means for enabling said flexible member to deflect gradually during circular motion whereby said elements close together while being displaced laterally.

21. The apparatus of claim 6 wherein the relative motion between said fabric gripping elements begins at a displacement angle between about 20° and 45°, measured relative to perpendicular to said gripping elements.

22. The pickup device of claim 1 wherein a said gripping element is defined by a plurality of segments adapted to resiliently deflect relative to one another in the direction of extent of the plane of said piece of fabric.

23. A fabric handling apparatus comprising an array of pickup devices according to claim 1, including sets of pickup devices disposed at opposite edges of said piece, and means to rotate the array of pickup devices about a horizontal axis to turn the piece of fabric upside down and means to rotate the pickup devices about a vertical axis to turn the piece of fabric end for end.

24. A pickup device according to claim 1 wherein each of said gripping elements comprises a straight support portion, said portions adapted to come together face to face when the fabric is clamped, each of said support portions having teeth that project outwardly from the edge of said support portion, when said support portions are together the tips of said teeth being close together and the base portions of said teeth being spaced from one another to accommodate gathered fabric.

25. The pickup device of claim 24 wherein said gripping elements comprise saw blades that have been machined on the inner surface of said blade to reduce the thickness of said teeth relative to the body of said blade, and the tips of said teeth being bent inwardly relative to the original plane of the blade.

26. The pickup device of claim 25 wherein the tips of said gripping elements extend inwardly beyond the inner face of said support portion to a position enabling entry in the space between teeth of the opposed gripping elements.

27. The pickup device of claim 1, wherein said gripping elements define teeth that have frontal surfaces that extend substantially perpendicular to the face of the piece to be picked up, and rearward surfaces that extend from points of the teeth at an acute angle to said face, said teeth being arranged so that said frontal surfaces are directed to advance along and disturb the piece to aid in pickup when said gripping elements move toward pickup position, the shape of said teeth preventing detrimental piercing below said piece.

28. The pickup device of claim 1 wherein said gripping elements define teeth that have frontal surfaces in the direction of travel to tension the fabric that extend substantially perpendicular to the face of the piece to be picked up, and rearward surfaces that extend from points of the teeth at an acute angle to said face, said teeth being arranged so that said frontal surfaces are directed to advance along and disturb the piece to aid in pickup when said gripping elements move toward pickup position, said teeth being effective to grip said top piece without detrimentally disturbing said second piece.

29. A pickup apparatus for removing a single piece of flexible fabric or the like from a stack of said pieces comprising means for clamping and applying tension to a first said fabric piece on the top of said stack, said means for applying tension comprising spaced apart fabric gripping elements, and means for producing relative movement between said elements to apply tension to said fabric, said means for producing relative movement of said fabric gripping elements being constructed and adapted to cause the fabric lying between said gripping elements to be tensioned by a lateral displacement motion and to be clamped by a closing motion, and means for directing the flow of air against and through the tensioned surface of said first fabric piece, whereby the application of tension to said first piece increases its open area for flow of air therethrough, said air thereby impinging efficiently upon the surface of the next underlying piece to facilitate separation of said first piece from said stack.

* * * * *

UNITED STATES PATENT AND TRADEMARK OFFICE

CERTIFICATE OF CORRECTION

PATENT NO. : 4,645,193

DATED : February 24, 1987

INVENTOR(S) : Richard R. Walton and George E. Munchbach

It is certified that error appears in the above-identified patent and that said Letters Patent are hereby corrected as shown below:

Col. 1, l. 53, "1,708,195" should be --1,780,195--

Col. 11, l. 16, "tension" should be --tensioned--

Signed and Sealed this

Eleventh Day of August, 1987

*Attest:*

DONALD J. QUIGG

*Attesting Officer*

*Commissioner of Patents and Trademarks*